US011208747B2

(12) United States Patent
Ueda et al.

(10) Patent No.: US 11,208,747 B2
(45) Date of Patent: Dec. 28, 2021

(54) EMBROIDERY FRAME

(71) Applicant: BROTHER KOGYO KABUSHIKI KAISHA, Nagoya (JP)

(72) Inventors: Daisuke Ueda, Seto (JP); Yasuhiko Kawaguchi, Nagoya (JP); Nobuhiko Funato, Gifu (JP); Midori Komada, Matsusaka (JP); Kiyomi Kato, Ama (JP); Takahira Osamura, Kitanagoya (JP); Kouji Makiyama, Tokai (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 177 days.

(21) Appl. No.: 16/587,222

(22) Filed: Sep. 30, 2019

(65) Prior Publication Data

US 2020/0024783 A1 Jan. 23, 2020

Related U.S. Application Data

(63) Continuation of application No. PCT/JP2017/030298, filed on Aug. 24, 2017.

(30) Foreign Application Priority Data

Mar. 29, 2017 (JP) ..... JP2017-065876

(51) Int. Cl.
*D05C 9/04* (2006.01)
*D05B 39/00* (2006.01)
*D05C 9/22* (2006.01)

(52) U.S. Cl.
CPC ..... *D05C 9/04* (2013.01); *D05B 39/00* (2013.01); *D05C 9/22* (2013.01); *D05D 2207/06* (2013.01)

(58) Field of Classification Search
CPC . D05B 39/00; D05C 9/04; D05C 9/22; D05D 2207/06
(Continued)

(56) References Cited

U.S. PATENT DOCUMENTS 7,194,968 B2 * 3/2007 Okazaki ..... D05C 9/04 112/103
2008/0276849 A1 * 11/2008 Mack ..... D05C 9/04 112/103
(Continued)

FOREIGN PATENT DOCUMENTS

JP S60-9482 U 1/1985
JP H05-269280 A 10/1993
(Continued)

OTHER PUBLICATIONS

Oct. 24, 2017 International Search Report issued in International Patent Application No. PCT/JP2017/030298.

*Primary Examiner* — Nathan E Durham
(74) *Attorney, Agent, or Firm* — Oliff PLC

(57) ABSTRACT

An embroidery frame includes a mounting portion to be mounted on a sewing machine and a frame portion. The frame portion has a first frame, a hinge portion, a second frame, a first clamping portion, and a second clamping portion. The first frame is connected to the mounting portion. The hinge portion is connected to one end of the first frame. The second frame is connected at one end to the hinge portion such that the second frame is able to rotate with respect to the first frame. The first clamping portion is configured to clamp the first sewing object together with the first frame while the second frame is open with respect to the first frame. The second clamping portion is configured to clamp the second sewing object together with the second frame while the second frame is open with respect to the first frame.

11 Claims, 10 Drawing Sheets

(58) Field of Classification Search
USPC ..... 112/103
See application file for complete search history.

(56) References Cited

U.S. PATENT DOCUMENTS

| | | | |
|---|---|---|---|
| 2011/0056420 | A1 | 3/2011 | Kawaguchi et al. |
| 2015/0225882 | A1 | 8/2015 | Ihira |

FOREIGN PATENT DOCUMENTS

| | | | |
|---|---|---|---|
| JP | 2002-136785 | A | 5/2002 |
| JP | 2004-337575 | A | 12/2004 |
| JP | 2011-055887 | A | 3/2011 |
| JP | 2015-048538 | A | 3/2015 |
| JP | 2015-147008 | A | 8/2015 |

* cited by examiner

EMBROIDERY FRAME

CROSS-REFERENCE TO RELATED APPLICATION

This application is a continuation application of International Application No. PCT/JP2017/030298, filed Aug. 24, 2017, which claims priority from Japanese Patent Application No. 2017-065876, filed on Mar. 29, 2017. The disclosure of the foregoing application is hereby incorporated by reference in its entirety.

BACKGROUND

The present disclosure relates to an embroidery frame to be mounted on a sewing machine capable of embroidery sewing.

An embroidery frame to be mounted on a sewing machine capable of embroidery sewing is known. With a related embroidery frame, while a first sewing object is clamped between a cloth frame and a front frame, a second sewing object is overlapped on the surface of the first sewing object, and the second sewing object can additionally to be clamped by the front frame and an inner frame. When sewing a stuffed toy or the like with a sewing machine on which the embroidery frame is mounted, a pattern is first embroidered on the first sewing object, and then the second sewing object is held to the surface of the first sewing object, and sewing can be performed along the outline of the pattern.

SUMMARY

With the related embroidery frame, when patterns are sewn on both the first sewing object and the second sewing object, the operation of overlapping the first sewing object and the second sewing object taking the arrangement of the patterns into account becomes complicated.

Various embodiments of the broad principles derived herein provide an embroidery frame to be mounted on a sewing machine capable of embroidery sewing, in which it is easy to position the second sewing object relative to the first sewing object by a simpler operation than in the past, even when a pattern is embroidered on both the first sewing object and the second sewing object.

Embodiments provide an embroidery frame that includes a mounting portion and a frame portion. The mounting portion is a portion to be mounted on a sewing machine capable of embroidery sewing. The frame portion is configured to hold a first sewing object and a second sewing object. The frame portion has a first frame, a hinge portion, a second frame, a first clamping portion, and a second clamping portion. The first frame is connected to the mounting portion and configured to hold the first sewing object. The hinge portion is connected to one end of the first frame. The second frame is connected at one end to the hinge portion such that the second frame is able to rotate with respect to the first frame. The second frame has a frame shape. The second frame is configured to hold the second sewing object. The first clamping portion is configured to clamp the first sewing object together with the first frame while the second frame is open with respect to the first frame. The second clamping portion is configured to clamp the second sewing object together with the second frame while the second frame is open with respect to the first frame.

BRIEF DESCRIPTION OF THE DRAWINGS

Embodiments will be described below in detail with reference to the accompanying drawings in which.

DETAILED DESCRIPTION

Figure 1:
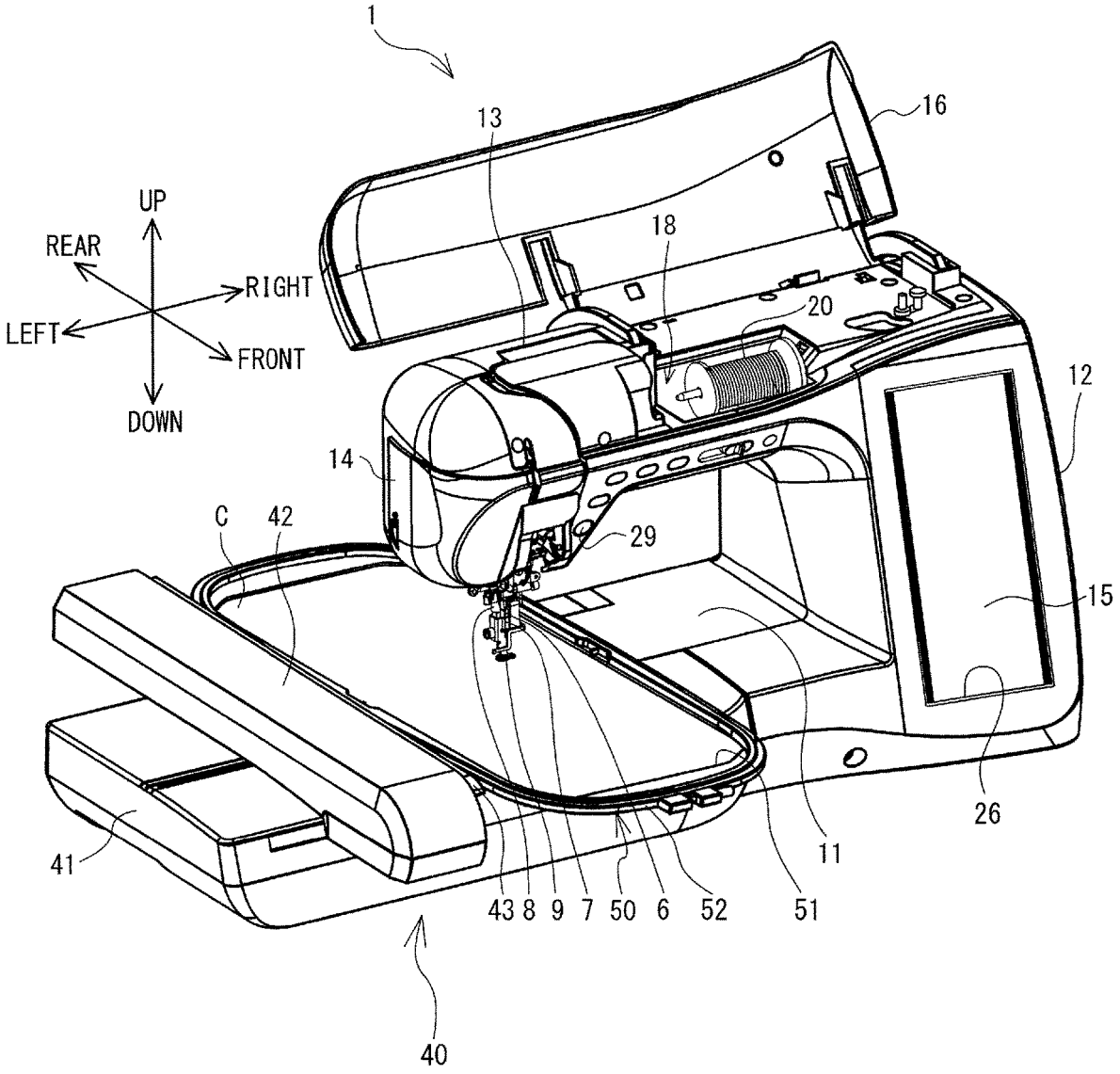
FIG. 1 is a perspective view of a sewing machine on which an embroidery frame transport device is mounted.

An embodiment of the present disclosure will be explained with reference to the drawings. A physical configuration of a sewing machine 1 on which an embroidery frame movement mechanism (hereinafter referred to as the movement mechanism) 40 is mounted will be explained with reference to FIG. 1 and FIG. 2. The up-down direction, the lower right side, the upper left side, the lower left side and the upper right side of FIG. 1 respectively correspond to the up-down direction, the front side, the rear side, the left side and the right side of the sewing machine 1 on which the movement mechanism 40 is mounted. The longitudinal direction of a bed portion 11 and an arm portion 13 is the left-right direction of the sewing machine 1, and the side on which a pillar 12 is disposed is the right side. The extending direction of the pillar 12 is the up-down direction of the sewing machine 1.

As shown in FIG. 1, the sewing machine 1 is provided with the bed portion 11, the pillar 12, the arm portion 13 and a head portion 14. The bed portion 11 is a base portion of the sewing machine 1 and extends in the left-right direction. The pillar 12 is provided so as to extend upward from the right end portion of the bed portion 11. The arm portion 13 faces the bed portion 11 and extends to the left from the upper end of the pillar 12. The head portion 14 is coupled to the left leading end portion of the arm portion 13.

A feed dog, a feed mechanism, a shuttle mechanism and the like, which are not shown in the drawings, are provided inside the bed portion 11 of the sewing machine 1. When normal sewing that is not embroidery sewing is performed, the feed dog is driven by the feed mechanism and moves the sewing object by a predetermined movement amount. The shuttle mechanism entwines an upper thread (not shown in the drawings) with a lower thread (not shown in the drawings) below a needle plate (not shown in the drawings) that is provided on an upper surface of the bed portion 11. The pillar 12 is internally provided with a sewing machine motor 31 (refer to FIG. 2). An upper portion of the arm portion 13 is provided with a cover 16 that can open and close. FIG. 1 shows the sewing machine 1 when the cover 16 is in an open state. When the cover 16 is in a closed state, a thread housing portion 18 is provided below the cover 16 (namely, inside the arm portion 13). The thread housing portion 18 can house a thread spool 20 around which the upper thread is wound. A drive shaft (not shown in the drawings) that extends in the left-right direction is provided inside the arm portion 13. The drive shaft is rotationally driven by the sewing machine motor 31. The head portion 14 is provided with a needle bar 6, a pressor bar 8, and the like. The sewing needle 7 is detachably mounted on the lower end of the needle bar 6. A pressor foot 9 is detachably attached to the lower end portion of the pressor bar 8. The needle bar 6 is driven in the up-down direction by the rotation of the drive shaft.

The movement mechanism 40 is configured to be removably mounted on the bed portion 11 of the sewing machine 1. The movement mechanism 40 is configured to relatively move an embroidery frame 50 configured to hold a sewing object C by a first frame 51 and a second frame 52, with respect to the needle bar 6. The single embroidery frame selected from among a plurality of types of embroidery frames including the embroidery frame 50 and an embroidery frame 80 (refer to FIG. 3) described later, can be mounted on and removed from the movement mechanism 40. The movement mechanism 40 is provided with a main body portion 41 and a carriage 42. The carriage 42 is provided with a holder 43, a Y axis movement mechanism (not shown in the drawings) and a Y axis motor 33 (refer to FIG. 2). The holder 43 is provided on the right side surface of the carriage 42. The embroidery frame 50 is configured to be mounted on and removed from the holder 43. The Y axis movement mechanism causes the holder 43 to move in the front-rear direction (a Y axis direction). The Y axis motor 33 is configured to drive the Y axis movement mechanism.

Figure 2:
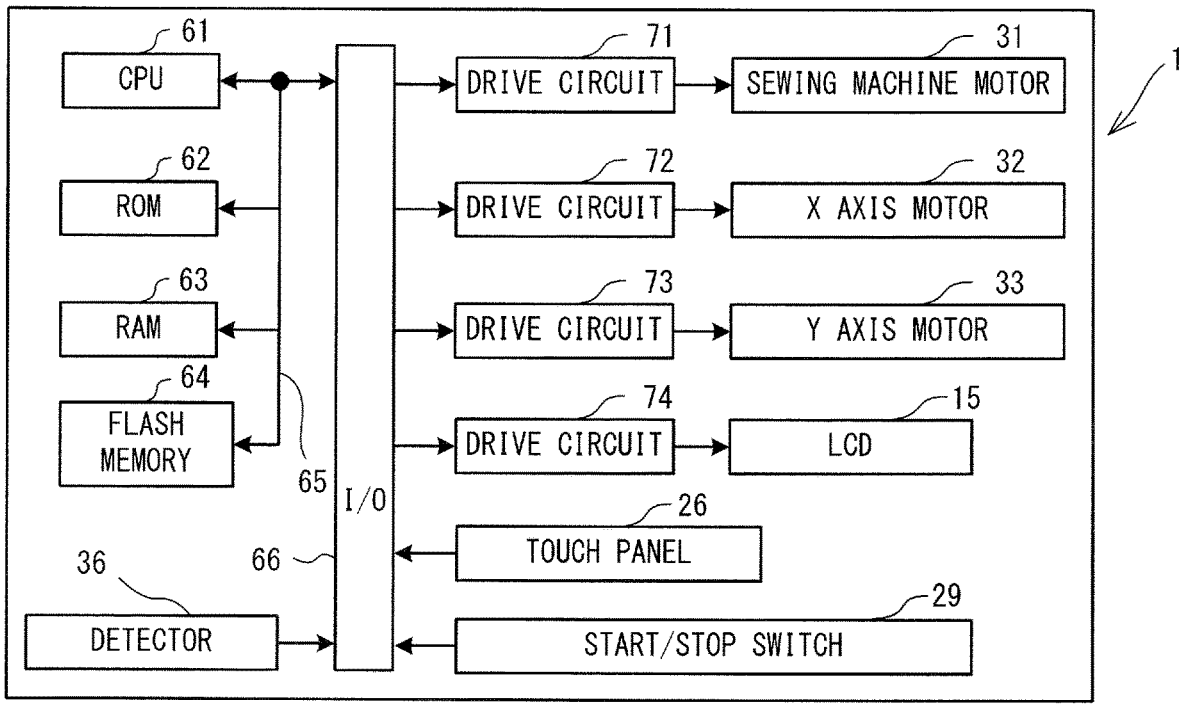
FIG. 2 is a block diagram showing an electrical configuration of the sewing machine.
Figure 3:
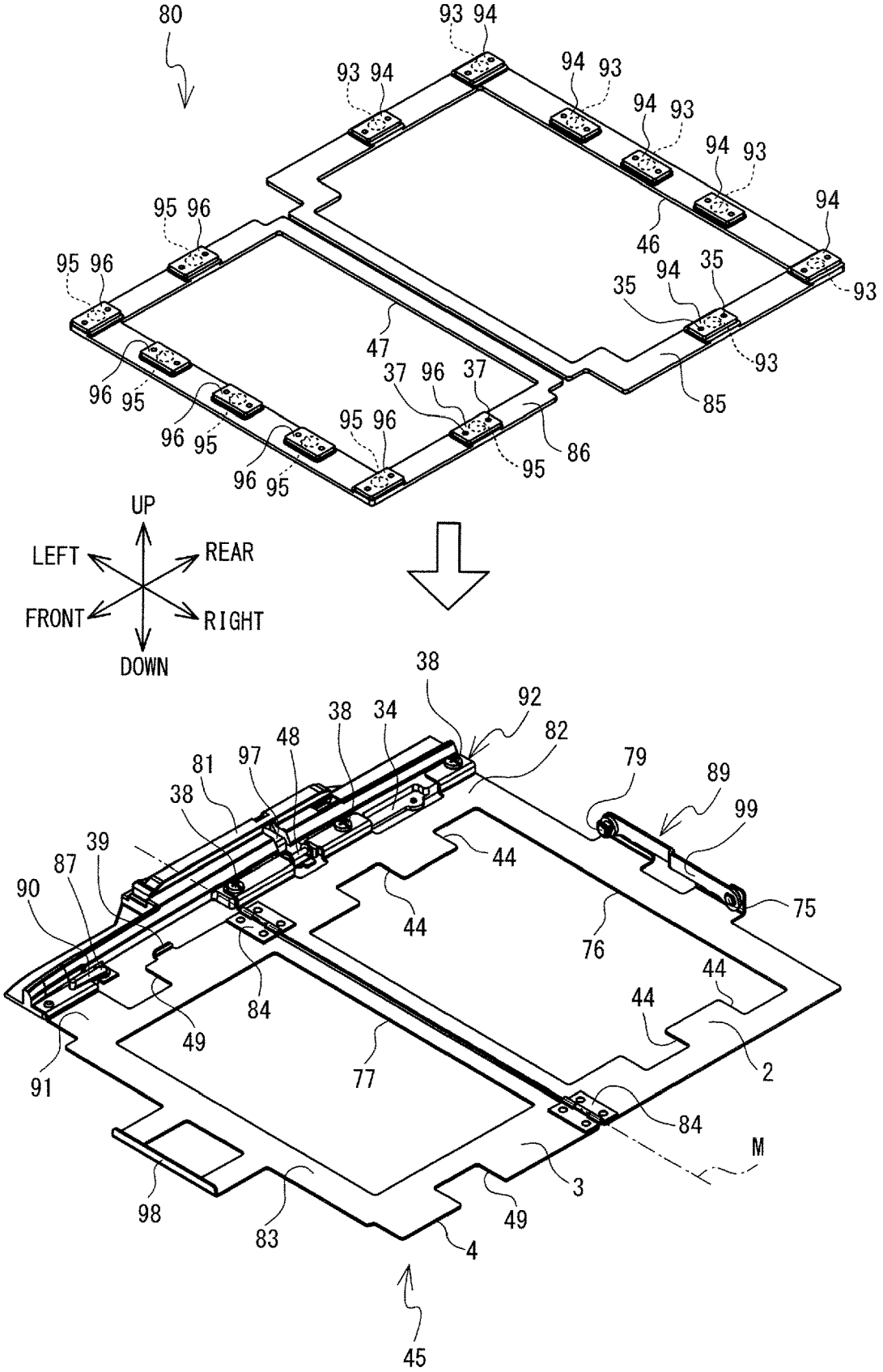
FIG. 3 is a perspective view of an embroidery frame in which a second frame is open with respect to the first frame, and a first clamping portion and a second clamping portion are spaced apart from the first frame and the second frame.

The main body portion 41 is internally provided with an X axis movement mechanism (not shown in the drawings) and an X axis motor 32 (refer to FIG. 2). The X axis movement mechanism causes the carriage 42 to move in the left-right direction (an X axis direction). The X axis motor is configured to drive the X axis movement mechanism. When embroidery sewing is performed using the embroidery frame 50, the movement mechanism 40 is configured to move the embroidery frame 50 mounted on the carriage 42 (more specifically, on the frame holder) to a position indicated by an XY coordinate system (an embroidery coordinate system) specific to the embroidery frame 50.

An electrical configuration of the sewing machine 1 will be explained with reference to FIG. 2. The sewing machine 1 is provided with the CPU 61, a ROM 62, the RAM 63, the flash memory 64 and an input/output (I/O) interface 66. The CPU 61 is connected to the ROM 62, the RAM 63, the flash memory 64 and the I/O interface 66, via a bus 65.

The CPU 61 performs overall control of the sewing machine 1 and performs various types of calculations and processing that relate to sewing, in accordance with various programs stored in the ROM 62. The ROM 62 is provided with a plurality of storage areas (not shown in the drawings) including a program storage area. The various programs (including a program to execute sewing processing described later) to operate the sewing machine 1 are stored in the program storage area.

The RAM 63 is provided with a storage area to store calculation results etc. obtained by the CPU 61 performing arithmetic processing. The flash memory 64 stores various parameters etc. for the sewing machine 1 to perform various types of processing. The flash memory 64 may store, for each of a plurality of patterns, the embroidery data for sewing patterns that can be sewn by the sewing machine 1. The embroidery data includes stitch data for each piece of color change data. The color change data is data indicating the color of thread that forms a stitch. The stitch data is data indicating a stitch forming position (needle drop position) included in the pattern by coordinates in an embroidery coordinate system. That is, the stitch data includes data groups indicating a plurality of coordinates for each needle drop point. The flash memory 64 may further store the correspondence between the type of embroidery frame that can be mounted on the holder 43, and the sewing area. The sewing area is the area where sewing is possible, which is set inside the embroidery frame that is mounted on the holder 43 of the sewing machine 1. Drive circuits 71 to 74, the touch panel 26, the start/stop switch 29, and the detector 36 are connected to the I/O interface 66. The detector 36 detects that the embroidery frame 50 has been mounted on the movement mechanism 40, and outputs a detection result corresponding to the type of the embroidery frame. The detector 36 of the present embodiment is configured to detect the type of embroidery frame according to the ON and OFF combination of a plurality of mechanical switches (for example, refer to Japanese Laid-Open Patent Publication No. 2015-147008, the relevant portions of which are herein incorporated by reference). Furthermore, the detector 36 of the present embodiment is configured to detect the open/closed state of the embroidery frame 80 when the embroidery frame 80 is mounted on the holder 43. The detector for detecting the type of embroidery frame and the detector for detecting the state of the embroidery frame may be separate, or the detector may be omitted as necessary.

The drive circuit 71 is connected to the sewing machine motor 31. The drive circuit 71 drives the sewing machine motor 31 in accordance with a control signal from the CPU 61. When the sewing machine motor 31 is driven, the needle bar up-and-down movement mechanism is driven via the drive shaft (not shown in the drawings) of the sewing machine 1, and the needle bar 6 moves up and down. The drive circuit 72 is connected to the X axis motor 32. The drive circuit 73 is connected to the Y axis motor 33. The drive circuits 72 and 73 drive the X axis motor 32 and the Y axis motor 33, respectively, in accordance with a control signal from the CPU 61. When the X axis motor 32 and the Y axis motor 33 are driven, the embroidery frame 50 mounted on the movement mechanism 40 moves in the left-right direction (the X axis direction) and the front-rear direction (the Y axis direction) by a movement amount corresponding to the control signal. The drive circuit 74 drives the LCD 15 in accordance with a control signal from the CPU 61, and causes an image to be displayed on the LCD 15.

Operations of the sewing machine 1 will be explained briefly. When embroidery sewing is performed using the embroidery frame, the needle bar up-and-down movement mechanism (not shown in the drawings) and the shuttle mechanism (not shown in the drawings) are driven in combination with the embroidery frame being moved in the X axis direction and the Y axis direction by the movement mechanism 40. Thus, an embroidery pattern is sewn on the sewing object C held by the embroidery frame, using the sewing needle 7 mounted on the needle bar 6.

The embroidery frame 80 will now be described with reference to FIG. 3 to FIG. 7, and FIG. 9. The embroidery frame 80 is used, for example, when making a stuffed toy onto which an embroidery pattern is sewn, or a bag onto which an embroidery pattern is sewn. The embroidery frame 80 includes a mounting portion 81 and a frame portion 45. The mounting portion 81 is a portion to be mounted on the sewing machine 1 capable of embroidery sewing. The frame portion 45 is a portion that can hold a first sewing object C1 and a second sewing object C2 exemplified in FIG. 9. The frame portion 45 includes a first frame 82, a pair of hinge portions 84, a second frame 83, a first clamping portion 85, and a second clamping portion 86. The first sewing object C1 and the second sewing object C2 may be a single sewing object or separate sewing objects. In the description below, the configuration of the embroidery frame 80 will be described based on a state in which the second frame 83 is open with respect to the first frame 82 shown in FIG. 4(A). The up-down direction, the lower right side, the upper left side, the lower left side, and the upper right side in FIG. 4(A) and FIG. 4(B) correspond to the up-down direction, the right side, the left side, the front side, and the rear side, respectively, of the embroidery frame 80 mounted on the movement mechanism 40. The longitudinal direction of the mounting portion 81 is the front-rear direction of the embroidery frame 80. The side on which mounting portion 81 is arranged is the left side.

The mounting portion 81 is a portion that is to be detachably mounted on the holder 43 of the sewing machine 1, with the front-rear direction being the longitudinal direction. The mounting portion 81 has a connecting portion 92 that connects to the first frame 82 on one end side in the longitudinal direction of the mounting portion 81, and has a restricting portion 78 on the other end side in the longitudinal direction. The mounting portion 81 of the present embodiment has the connecting portion 92 that protrudes toward the right on a rear end portion of the mounting portion 81, and has the restricting portion 78 on a front end side of the mounting portion 81. The restricting portion 78 restricts the second frame 83 from rotating beyond a predetermined angle with respect to the first frame 82. The predetermined angle is set, as appropriate, according to the configuration of the sewing machine 1, and the predetermined angle of the present embodiment is 180 degrees extending substantially parallel to the upper surface of the bed portion 11. That is, the first frame 82 and the second frame 83 are arranged on the same plane, when the second frame 83 is open with respect to the first frame 82. The predetermined angle may be an angle with a set range (from 178 degrees to 182 degrees, for example). The restricting portion 78 of the present embodiment is a portion that protrudes in the direction (toward the right) toward the second frame 83 from the mounting portion 81 when the second frame 83 is open with respect to the first frame 82.

Figure 9:
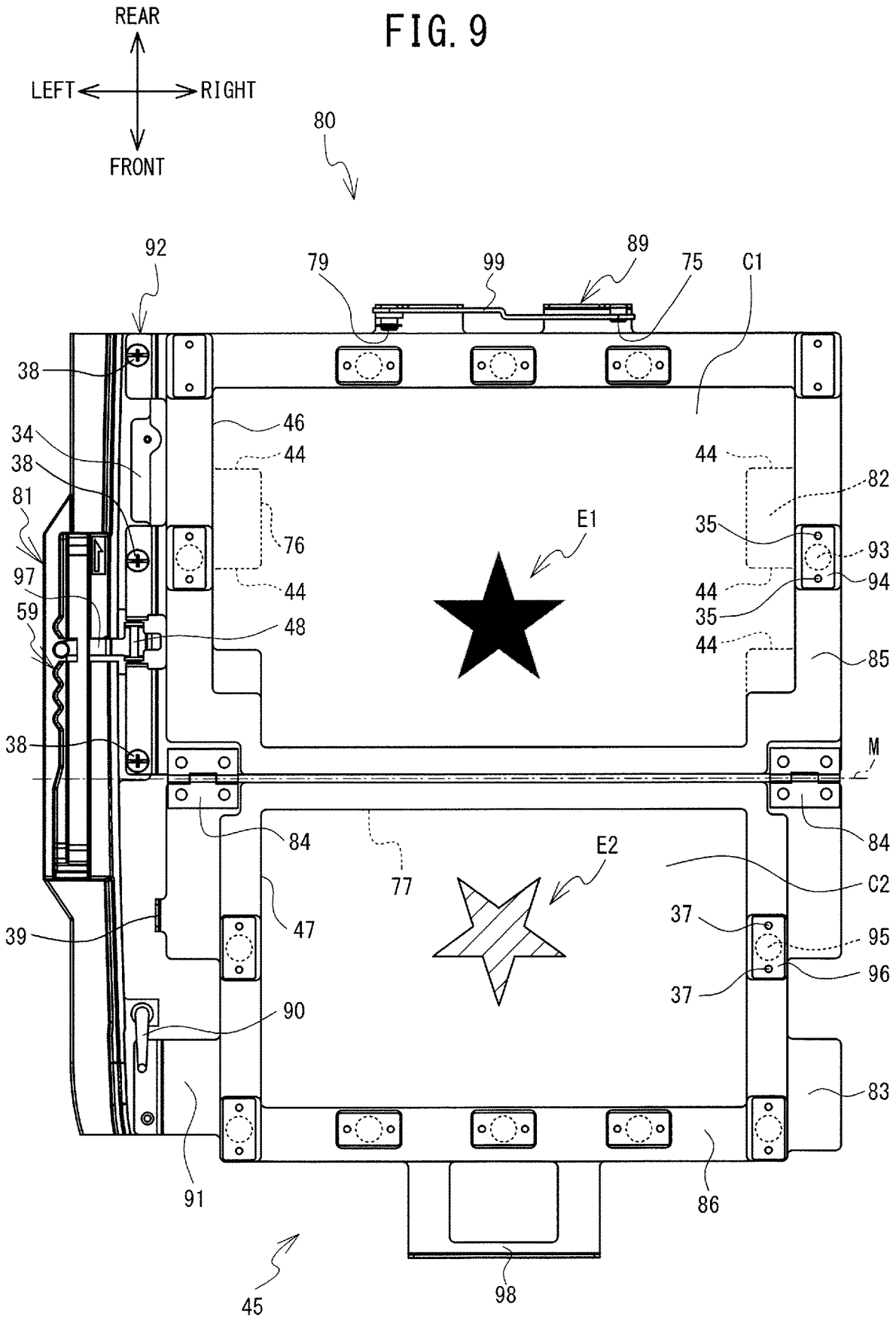
FIG. 9 is an explanatory view of a first pattern to be sewn to a first sewing object clamped to the embroidery frame, and a second pattern to be sewn to a second sewing object clamped to the embroidery frame, in a state in which the second frame is open with respect to the first frame.

As shown in FIG. 9, the mounting portion 81 has, on a left portion, four protruding portions 59 protruding toward the left that are arranged in the front-rear direction and indicate the type of the embroidery frame 80. The sewing machine 1 on which the embroidery frame 80 is mounted detects, with a plurality of mechanical switches, the arrangement of the four protruding portions 59 and a detection portion 97, described later, and can detect the type as well as the open/closed state of the embroidery frame 80.

The first frame 82 is a frame-shaped member that is connected to the mounting portion 81 and can hold the first sewing object C1. The first frame 82 of the present embodiment has a frame shape that is rectangular in a plan view, and a left end portion is fixed by three screws 38 to the connecting portion 92 of the mounting portion 81. The three screws 38 extend in the up-down direction and are arranged at substantially equal intervals in the front-rear direction. The first frame 82 includes a first magnetic body 2. The entire first frame 82 of the present embodiment is formed by the first magnetic body 2 of stainless steel or the like. An inner periphery 76 of the first frame 82 has, on each of the left side portion and the right side portion of the inner periphery 76, two recessed portions 44 that are recessed toward the side away from the region surrounded by the largest rectangle inscribed in the inner periphery 76. The embroidery frame 80 has, on the rear end of the first frame 82, a lock mechanism 89 that fixes the second frame 83 to the first frame 82 when the second frame 83 is closed with respect to the first frame 82. This lock mechanism 89 will be described later.

The pair of hinge portions 84 are connected to one end of the first frame 82. The pair of hinge portions 84 are connected to the left end portion of the front end of the first frame 82 and the right end portion of the front end of the first frame 82, respectively. The rotational center M of the hinge portions 84 extends in a direction intersecting the longitudinal direction of the mounting portion 81. The longitudinal direction of the mounting portion 81 of the present embodiment is the front-rear direction, and the rotational axis of the hinge portions 84 extends in the left-right direction. That is, the rotational axis of the hinge portions 84 of the present embodiment extends in a direction orthogonal to the longitudinal direction of the mounting portion 81 in a horizontal plane that is substantially parallel to the upper surface of the bed portion 11 of the sewing machine 1, when the embroidery frame 80 is mounted on the sewing machine 1.

The second frame 83 is a frame-shaped member of which one end is connected to the pair of hinge portions 84 in a manner rotatable with respect to the first frame 82, and is capable of holding the second sewing object C2. That is, the first frame 82 and the second frame 83 are connected by the pair of hinge portions 84, such that the second frame 83 can rotate with respect to the first frame 82. The second frame 83 includes a second magnetic body 3. The entire second frame 83 of the present embodiment is formed by the second magnetic body 3 of stainless steel or the like. The second frame 83 has a frame shape that is rectangular in a plan view, and the shape of the region surrounded by an inner periphery 77 of the second frame 83 is rectangular in a plan view. The second frame 83 has, on each of a left side portion and a right side portion of an outer periphery 4 of the second frame 83, one recessed portion 49 that is recessed toward the side of the region surrounded by the inner periphery 77.

The second frame 83 includes an abutting portion 91 that abuts against the restricting portion 78 of the mounting portion 81 when the second frame 83 is opened a predetermined angle with respect to the first frame 82. The abutting portion 91 is provided on the opposite side (the front side) of the second frame 83 from the side (the rear side) that is connected to the hinge portions 84, and on the side (the left side) of the second frame 83 that faces the restricting portion 78, i.e., the left front side of the second frame 83. The embroidery frame 80 has a fixing portion 90 that fixes the position of the second frame 83 with respect to the first frame 82 in a state where the abutting portion 91 is abutted against the restricting portion 78, that is, in a state where the second frame 83 is open with respect to the first frame 82. The fixing portion 90 is a bar-shaped lever that is configured to rotate about a shaft 87 that extends in a direction intersecting the restricting portion 78. The fixing portion 90 can fix the position of the second frame 83 with respect to the first frame 82 by clamping the abutting portion 91 of the second frame 83 together with the restricting portion 78 in the up-down direction, when the fixing portion 90 is oriented extending in the front-rear direction shown in FIG. 3. The fixing portion 90 unfixes the position of the second frame 83 with respect to the first frame 82 when the fixing portion 90 is oriented extending in the left-right direction shown in FIG. 4(B). The second frame 83 has a gripping portion 98 on the front end. The gripping portion 98 is a plate-shaped portion that has an L-shape created by the front end protruding upward in a right side view, and has a U-shape with the rear side being open in a plan view. The second frame 83 also has a protruding portion 39 that protrudes upward at a center portion, in the front-rear direction, of a left side portion of the second frame 83. The abutting portion 91 of the second frame 83 abuts against the upper surface of the abutting portion 34 of the connecting portion 92 of the mounting portion 81 when the second frame 83 is closed with respect to the first frame 82. The abutting portion 34 is a portion in substantially the center, in front-rear direction, of the connecting portion 92, which extends substantially parallel on the first frame 82 side (the rear side).

Figure 4A:
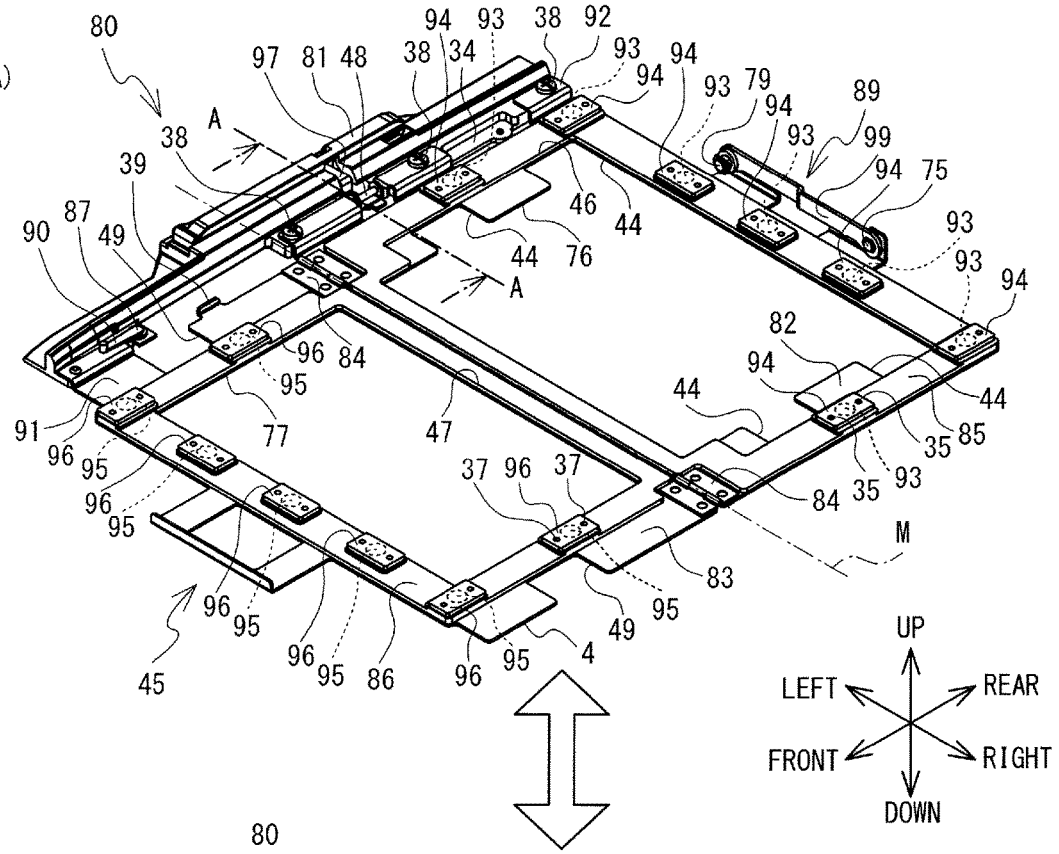
FIG. 4(A) is a perspective view of the embroidery frame in which the second frame is open with respect to the first frame, and the first clamping portion and the second clamping portion are arranged in clamping positions with respect to the first frame and the second frame.

The first clamping portion 85 is a member capable of clamping the first sewing object C1 together with the first frame 82, while the second frame 83 is open with respect to the first frame 82. The first clamping portion 85 is in the shape of a frame capable of clamping the first sewing object C1 with the first frame 82 by magnetic force, and includes a first magnet 93 in a position facing the first magnetic body 2 in a clamping position. The first clamping portion 85 of the present embodiment is in the shape of a rectangular frame having sides that extend in the front-rear direction and the left-right direction in a plan view. The clamping position of the present embodiment is a position where the overlapping portion of the first frame 82 and the first clamping portion 85 via the first sewing object C1 is largest, as shown in FIG. 4(A) and FIG. 9. In the clamping position, the front side and the rear side of the inner periphery 76 of the first frame 82, and the front side and the rear side of the inner periphery 46 of the first clamping portion 85, are substantially aligned in a plan view. In the clamping position, the first clamping portion 85 does not overlap with the hinge portions 84. The first clamping portion 85 is made of resin such as plastic resin. With the first clamping portion 85 of the present embodiment, two cylindrical first magnets 93 are disposed on each of the left side portion and the right side portion of the first clamping portion 85, and three first magnets 93 are disposed on the rear side portion of the first clamping portion 85. The first magnet 93 is not disposed on the front side portion (the portion on the hinge portions 84 side) of the first clamping portion 85. Each of the first magnets 93 is retained in a hole 68 recessed downward that is provided in an upper surface of the first clamping portion 85, as shown in FIG. 7(D). The first magnet 93 and the hole 68 are both covered from above by a yoke 94 that has a rectangular shape in a plan view. The yoke 94 is a magnetic body (an iron plate, for example) that guides the magnetic flux generated by the first magnet 93. The yoke 94 extends along the side of the first clamping portion 85, and both end portions in the longitudinal direction are fixed to the first clamping portion 85 from below by a pair of screws 35. Each of the first magnets 93 is disposed between the pair of screws 35 that fix the yoke 94 to the first clamping portion 85.

The second clamping portion 86 is a member capable of clamping the second sewing object C2 together with the second frame 83, while the second frame 83 is open with respect to the first frame 82. The second clamping portion 86 is in the shape of a frame capable of clamping the second sewing object C2 with the second frame 83 by magnetic force, and includes a second magnet 95 in a position facing the second magnetic body 3 in the clamping position. The second clamping portion 86 of the present embodiment is in the shape of a rectangular frame having sides that extend in the front-rear direction and the left-right direction in a plan view. The clamping position of the present embodiment is a position where the overlapping portion of the second frame 83 and the second clamping portion 86 via the second sewing object C2 is largest, as shown in FIG. 4(A) and FIG. 9. In the clamping position, the inner periphery 77 of the second frame 83 and the inner periphery 47 of the second clamping portion 86 are substantially aligned in a plan view. In the clamping position, the second clamping portion 86 does not overlap with the hinge portions 84. The second clamping portion 86 is made of resin such as plastic resin. With the second clamping portion 86 of the present embodiment, two cylindrical second magnets 95 are disposed on each of the left side portion and the right side portion of the second clamping portion 86, and three second magnets 95 are disposed on the front side portion of the second clamping portion 86. The second magnet 95 is not disposed on the rear side portion (the portion on the hinge portions 84 side) of the second clamping portion 86. Each of the second magnets 95 is retained in a hole (not shown in the drawings) recessed downward that is provided in an upper surface of the second clamping portion 86, similar to the first magnet 93. The upper surface of each of the second magnets 95 is covered from above by a yoke 96 that has a rectangular shape in a plan view. The yoke 96 is a magnetic body (an iron plate, for example) that guides the magnetic flux generated by the second magnet 95. The yoke 96 is fixed at both end portions in the longitudinal direction to the second clamping portion 86 by a pair of screws 37. Each of the second magnets 95 is disposed between the pair of screws 37 that fix the yoke 96 to the second clamping portion 86.

Figure 4B:
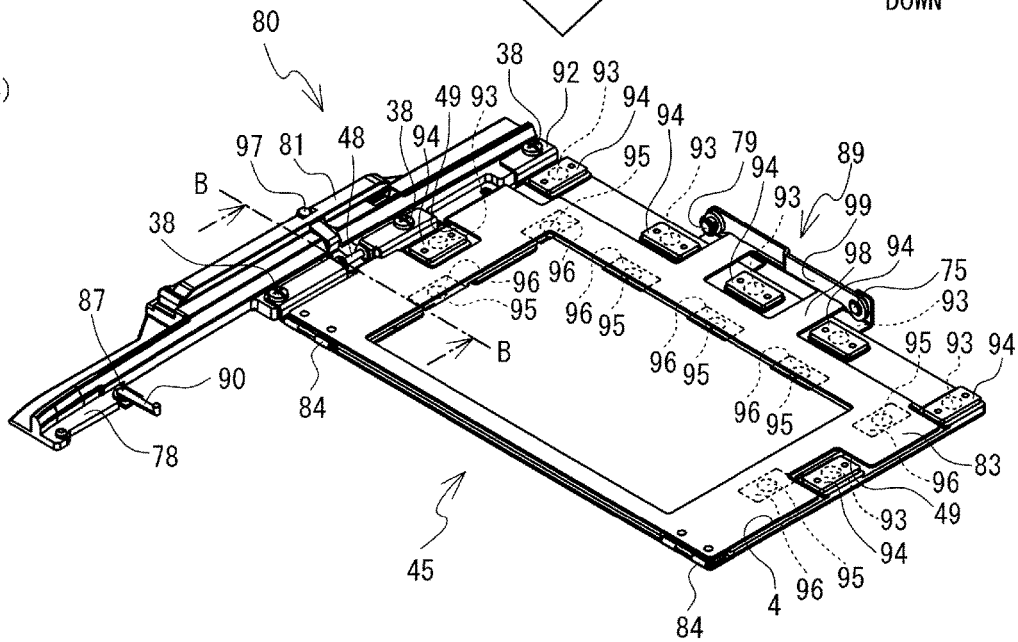
FIG. 4(B) is a perspective view of the embroidery frame in which the first clamping portion and the second clamping portion are arranged in clamping positions with respect to the first frame and the second frame, and the second frame is closed with respect to the first frame.

As shown in FIG. 4(B), when the first clamping portion 85 and the second clamping portion 86 are each provided in the clamping position, and the second frame 83 is closed with respect to the first frame 82, the left side and the right side of the inner periphery 77 of the second frame 83 each overlap with a portion of the inner periphery 76 of the first frame 82 where the recessed portions 44 are not provided. When the first clamping portion 85 and the second clamping portion 86 are each provided in the clamping position, and the second frame 83 is closed with respect to the first frame 82, the second clamping portion 86 is not in a position facing the first magnets 93, and the first clamping portion 85 is not in a position facing the second magnets 95. More specifically, while the second frame 83 is closed with respect to the first frame 82, the members of the embroidery frame 80 are in the following positional relationships. The left side portion, the rear side portion, and the right side portion of the first clamping portion 85, where the first magnets 93 are provided, are to the outside of a left side portion, a rear side portion, and a right side portion, respectively, of the second clamping portion 86. The left side portion, the rear side portion, and the right side portion of the first clamping portion 85 do not overlap in the up-down direction with the left side portion, the rear side portion, and the right side portion, respectively, of the second clamping portion 86. The first magnets 93 on the front side, of the two first magnets 93 on each of the left side portion and the right side portion of the first clamping portion 85, are disposed in the recessed portions 49 of the second frame 83, and the rear first magnets 93 are disposed to the rear of the second frame 83 and the second clamping portion 86. The three second magnets 95 disposed on the side portion on the side opposite the hinge portions 84 side in the front-rear direction of the second clamping portion 86 are disposed to the front of the rear side portion of the first frame 82 and the rear side portion of the first clamping portion 85. The two second magnets 95 disposed on each of the left side portion and the right side portion of the second clamping portion 86 are disposed in the recessed portions 44 corresponding to the first frame 82. None of the first magnets 93 are disposed overlapping with any of the second magnets 95 in the up-down direction.

Figure 5:
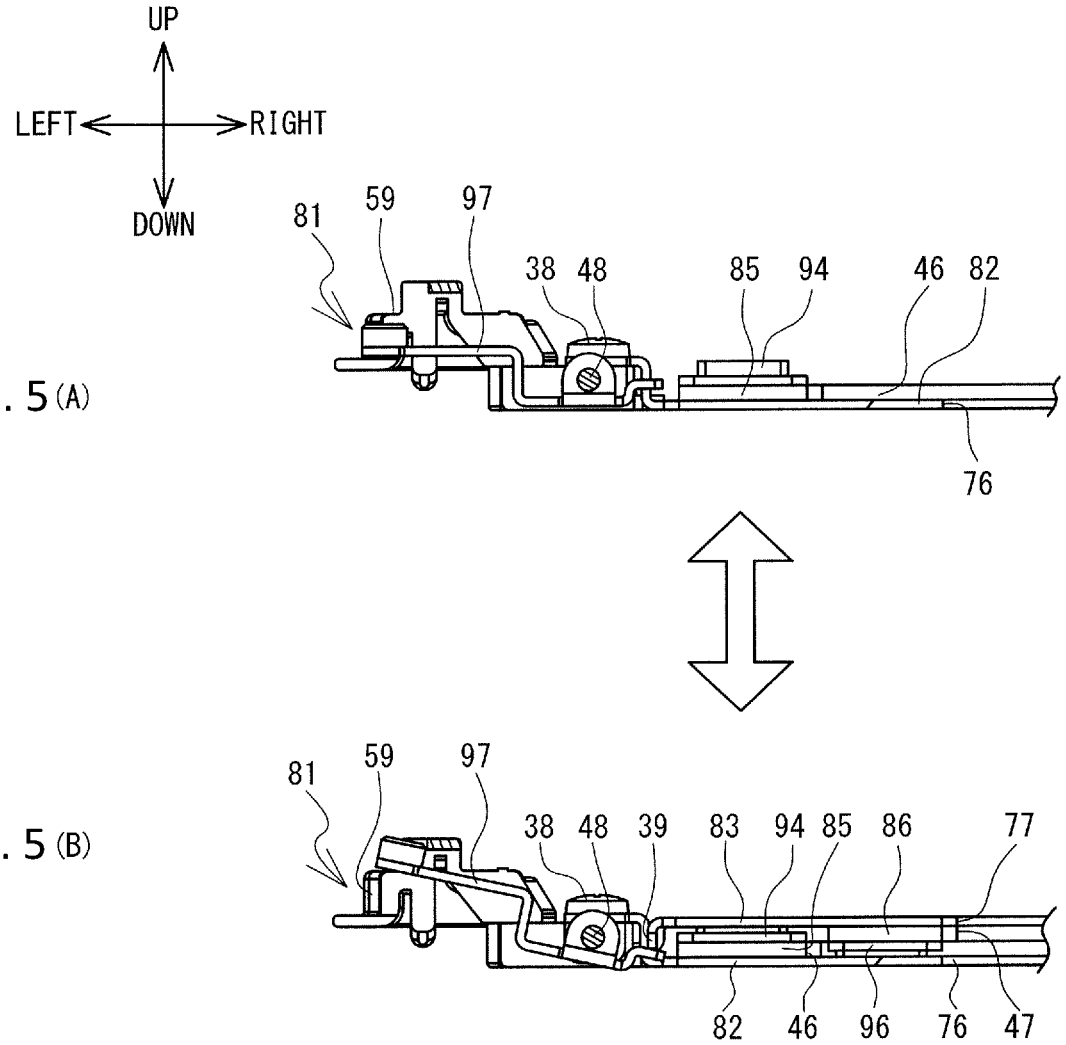
FIG. 5(A) is a sectional view taken along line A-A in FIG. 4(A)
FIG. 5(B) is a sectional view taken along line B-B in FIG. 4(B)

The embroidery frame 80 further includes the detection portion 97 that detects when the second frame 83 is closed with respect to the first frame 82. The detection portion 97 of the present embodiment is disposed in a recessed portion that is recessed downward and extends in the left-right direction, and is provided slightly to the rear of the center, in the front-rear direction, of the mounting portion 81, as shown in FIG. 4 and FIG. 5. The detection portion 97 has a lever shape that extends in the left-right direction. The detection portion 97 is rotatably supported on the mounting portion 81 by a shaft 48 that extends in the front-rear direction, in a position to the right of the center, in the left-right direction, of the mounting portion 81. When the second frame 83 is open with respect to the first frame 82, the left end portion of the detection portion 97 abuts against the mounting portion 81, as shown in FIG. 5(A). When the second frame 83 is closed with respect to the first frame 82, the right end of the detection portion 97 is pushed downward by the protruding portion 39 of the second frame 83, such that the shaft 48 rotates clockwise in a front view about the shaft 48, and the left end portion of the detection portion 97 separates from the mounting portion 81, as shown in FIG. 5(B). When the embroidery frame 80 is mounted on the sewing machine 1, the detector 36 of the sewing machine 1 can detect whether the second frame 83 of the embroidery frame 80 is closed with respect to the first frame 82, on the basis of the position in the up-down direction of the left end portion of the detection portion 97. More specifically, when the second frame 83 of the embroidery frame 80 is open with respect to the first frame 82, the left end portion of the detection portion 97 is at the same height as the four protruding portions 59 of the mounting portion 81, and abuts against a mechanical switch that is in a position facing the detection portion 97, of a plurality of mechanical switches of the detector 36, turning the mechanical switch ON. When the second frame 83 of the embroidery frame 80 is closed with respect to the first frame 82, the left end portion of the detection portion 97 is higher than the upper ends of the four protruding portions 59 of the mounting portion 81, so none of the plurality of mechanical switches of the detector 36 turn ON. The detector 36 of the sewing machine 1 can detect whether the second frame 83 of the embroidery frame 80 is closed with respect to the first frame 82, on the basis of the ON and OFF combination of the plurality of mechanical switches being different when the embroidery frame 80 is open than when the embroidery frame 80 is closed.

Figure 6:
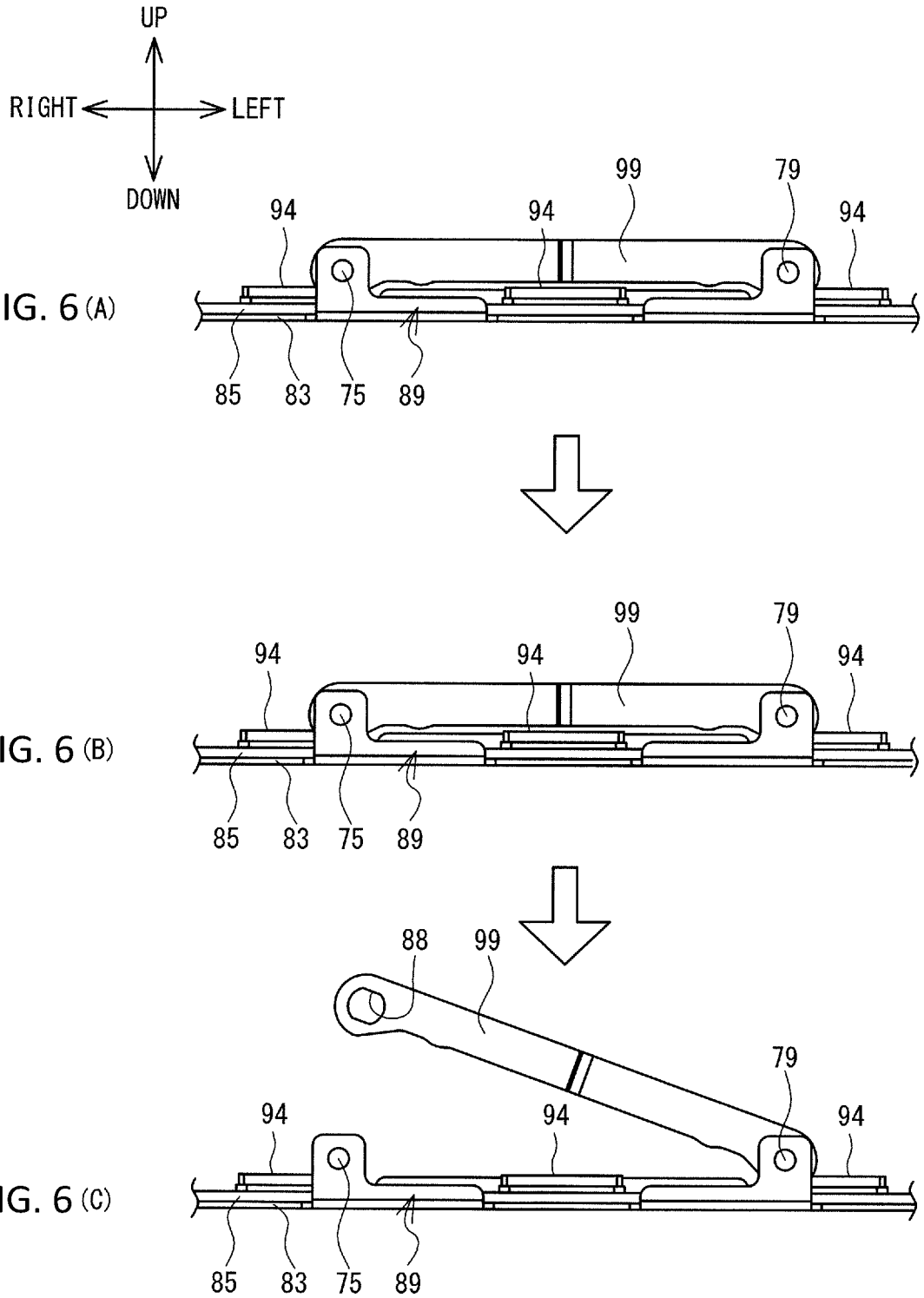
FIGS. 6(A) to 6(C) are explanatory views of the process of operating a lock mechanism from a lockable state to an unlocked state, when the lock mechanism is viewed from the back.
Figure 7:
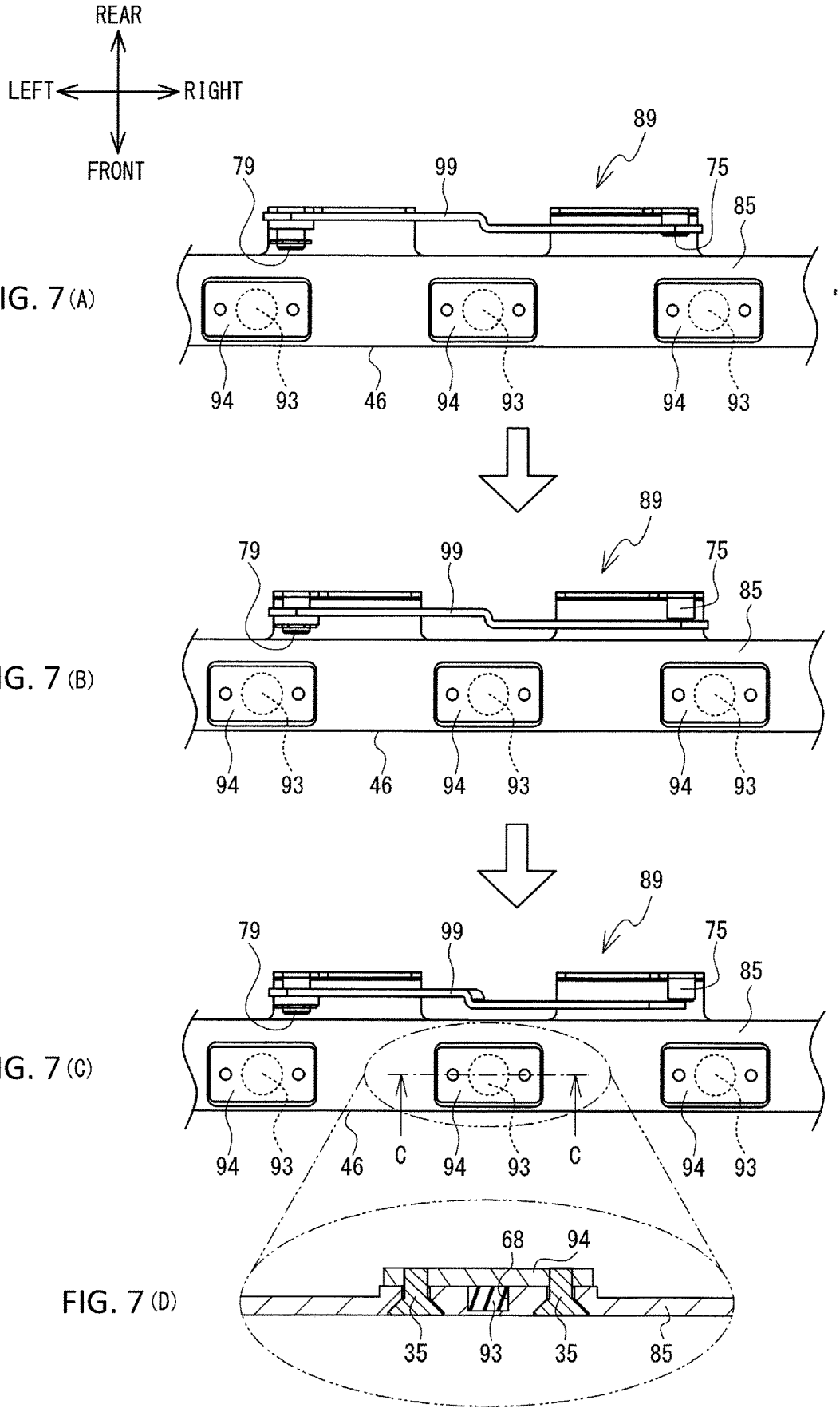
FIGS. 7(A) to 7(C) are explanatory views of the process of operating the lock mechanism from the lockable state to the unlocked state, when the lock mechanism is viewed from above.
FIG. 7(D) is a sectional view taken along line C-C in FIG. 7(C)

The lock mechanism 89 includes a lever 99 that is long in the left-right direction, and shafts 79 and 75 that extend in the front-rear direction, as shown in FIG. 6 and FIG. 7. The lever 99 has a hole 88 passing through it in the front-rear direction in the right end. The shaft 79 is inserted into the left end of the lever 99 and rotatably supports the lever 99. The shaft 75 can be inserted into the hole 88. When the shaft 75 is not inserted into the hole 88 and the right end portion of the lever 99 is disposed in front of the front end of the shaft 75, the lever 99 can rotate about the shaft 79, as shown in FIG. 6(B), FIG. 6(C), FIG. 7(B) and FIG. 7(C). When the second frame 83 is closed with respect to the first frame 82 while the lever 99 is separated from the shaft 75 in the up-down direction, the gripping portion 98 is disposed lower than the shafts 75 and 79. In this state, when the shaft 75 is inserted through the hole 88 in the lever 99, the lever 99 restricts the gripping portion 98 from moving upward, thereby fixing the second frame 83 with respect to the first frame 82, in the up-down direction, as shown in FIG. 6(A) and FIG. 7(A).

Figure 10:
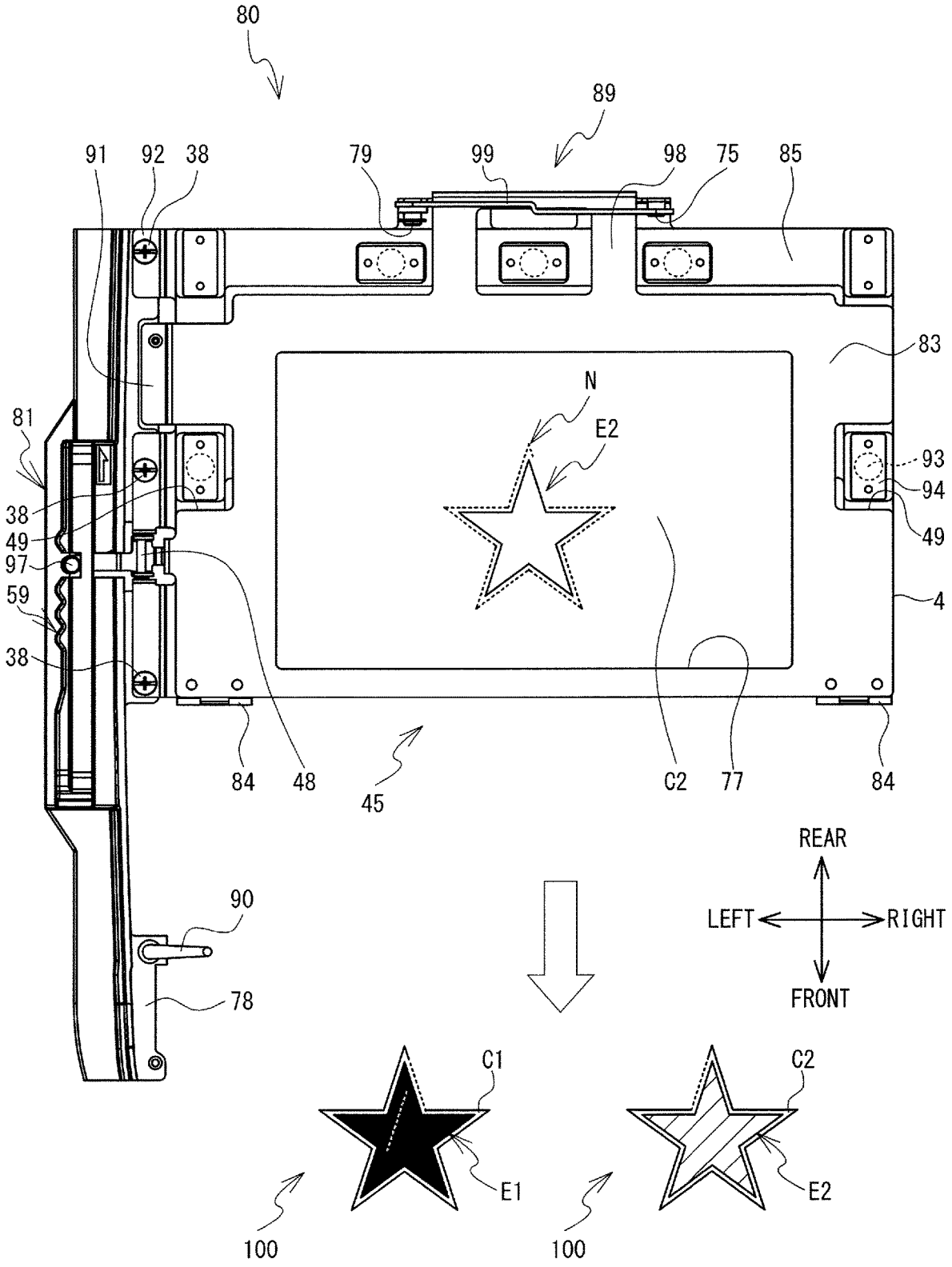
FIG. 10 is an explanatory view of the outline where the first sewing object and the second sewing object are overlapped and sewn together, while the second frame is closed with respect to the first frame, after sewing the first and second patterns, and a stuffed toy made by the sewing processing.

The sewing processing executed when sewing using the embroidery frame 80 will now be described with reference to FIG. 8 to FIG. 10. As a specific example, a case when making a star-shaped stuffed toy 100 shown in FIG. 10 will be described. When making the stuffed toy 100, the sewing machine 1 sews a star-shaped first pattern E1 with a first color thread on the first sewing object C1, and sews a star-shaped second pattern E2 with a second color thread on a second sewing object C2, in accordance with embroidery data. The sewing machine 1 sews an outline N around the patterns E1 and E2, in accordance with embroidery data, while the first sewing object C1 and the second sewing object C2 are overlapped. The embroidery data for sewing the patterns E1 and E2 and the outline N may be generated by the sewing machine 1, or the embroidery data may be stored beforehand in flash memory 64 or the like. The first pattern E1 and the second pattern E2 are arranged in line symmetry with the rotational center M of the hinge portions 84 as the axis of symmetry. Upon acquiring a start command to start the sewing processing, the CPU 61 reads a program for executing the sewing processing from the flash memory 64 into the RAM 63, and executes the sewing processing in accordance with instructions included in the program. The start command is input via the touch panel 26, together with instructions specifying the embroidery data, for example.

Figure 8:
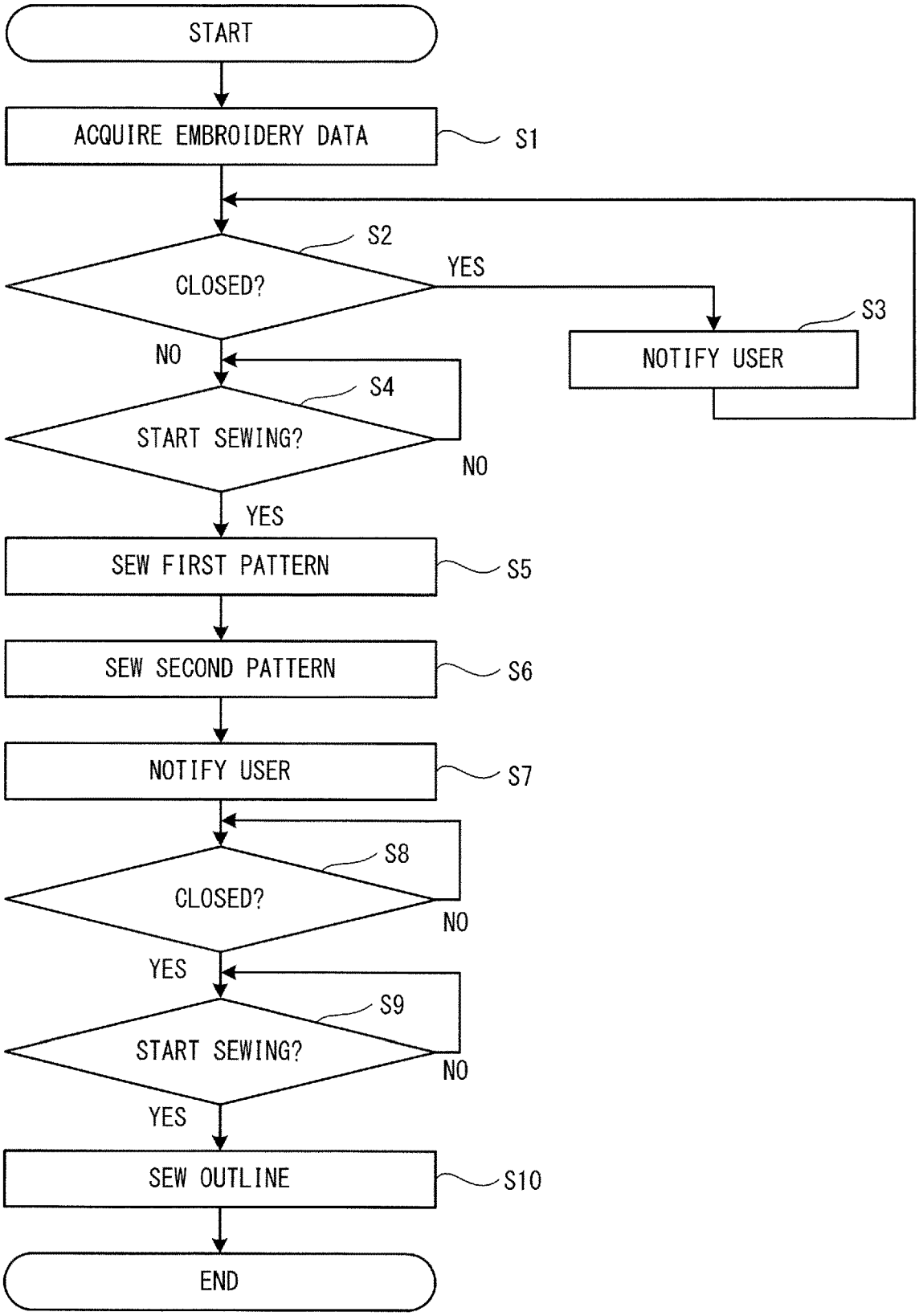
FIG. 8 is a flowchart of sewing processing executed by the sewing machine.

As shown in FIG. 8, the CPU 61 first acquires the embroidery data (step S1). In a specific example, embroidery data for sewing the patterns E1 and E2 and the outline N are acquired. The CPU 61 identifies the type of embroidery frame 80, and determines whether the embroidery frame 80 is closed, i.e., whether the second frame 83 is closed with respect to the first frame 82, on the basis of a signal from the detector 36 (step S2). If the embroidery frame 80 is closed (yes at step S2), the CPU 61 notifies a user of the state of the embroidery frame 80 by displaying, on the LCD 15, a message urging the user to open the embroidery frame 80, i.e., to open the second frame 83 with respect to the first frame 82 (step S3), after which the processing returns to step S2. If the embroidery frame 80 is open (no at step S2), the CPU 61 determines whether a command to start sewing has been input (step S4). The user clamps the first sewing object C1 with the first frame 82 and the first clamping portion 85, and clamps the second sewing object C2 with the second frame 83 and the second clamping portion 86, as shown in FIG. 9, for example. After confirming that the position of the second frame 83 is fixed with respect to the first frame 82 by the fixing portion 90 and the restricting portion 78, the user inputs a command to start sewing, by depressing the start/stop switch 29. If a command to start sewing has not been input (no at step S4), the CPU 61 returns the process to step S4. If a command to start sewing has been input (yes at step S4), the CPU 61 sews the first pattern E1 onto the first sewing object C1 in a sewing region to the inside of the inner periphery 76 of the first frame 82, in accordance with the embroidery data (step S5), as shown in FIG. 9. After sewing the first pattern E1, the CPU 61 sews the second pattern E2 onto the second sewing object C2 in a sewing region to the inside of the inner periphery 77 of the second frame 83 (step S6). If it is necessary to change the thread while sewing the first pattern E1 and the second pattern E2 due to the thread breaking or in order to change the thread color, in steps S5 and S6, the CPU 61 interrupts the sewing, as appropriate, and then resumes processing after the thread has been changed. The sewing order of the first pattern E1 and the second pattern E2 may be reversed.

After the sewing of the first pattern E1 and the second pattern E2 are complete, the CPU 61 notifies the user by displaying, on the LCD 15, a message urging the user to close the second frame 83 with respect to the first frame 82 (step S7). The CPU 61 moves the embroidery frame 80 to a position where the embroidery frame 80 can be changed from open to closed, as necessary. The user confirms the message on the LCD 15, and unfixes the position of the second frame 83 to the first frame 82 by operating the fixing portion 90. The user then closes the second frame 83 with respect to the first frame 82 and fixes the second frame 83 with respect to the first frame 82 with the lock mechanism 89, and then inputs a command to start sewing, as shown in FIG. 10. The CPU 61 determines whether the embroidery frame 80 is closed on the basis of a signal from the detector 36 (step S8). If the embroidery frame 80 is not closed (no at step S8), the CPU 61 returns the process to step S8.

If the embroidery frame 80 is closed (yes at step S8), the CPU 61 determines whether a command to start sewing has been input, similar to the processing at step S4 (step S9). If a command to start sewing has not been input (no at step S9), the CPU 61 returns the process to step S9. If a command to start sewing has been input (yes at step S9), the CPU 61 sews the outline N in a sewing region to the inside of the inner periphery 77 of the second frame 83 that is closed with respect to the first frame 82, in accordance with the embroidery data, as shown in FIG. 10 (step S10). The outline N of the present embodiment is a stitch formed a predetermined distance to the outsides of the outlines of the first pattern E1 and the second pattern E2, and a partially unsewn portion is provided as an opening for turning out, which will be described later. That is, the outline N does not go fully around the outsides of the first pattern E1 and the second pattern E2. The outline N may be a portion that overlaps with the outlines of the first pattern E1 and the second pattern E2. After sewing the outline N, the CPU 61 ends the sewing processing. The user removes the first sewing object C1 and the second sewing object C2 from the embroidery frame 80, and cuts along the outside of the outline N. The user then turns the first sewing object C1 and the second sewing object C2 inside out from the opening for turning out in the outline N, and stuffs the sewing object with cotton or the like through the opening for turning out, after which the user sews the opening for turning out by hand or with the sewing machine 1. In this way, the stuffed toy 100 in which the first pattern E1 has been sewn onto the first sewing object C1, as shown in the lower left of FIG. 10, and the second sewing object C2 has been sewn onto the second sewing object C2 on the opposite side from the first sewing object C1, as shown in the lower right of FIG. 10, is made.

The embroidery frame 80 of the above embodiment can clamp the first sewing object C1 with the first frame 82, and clamp the second sewing object C2 with the second frame 83. The embroidery frame 80 can be used to sew the first pattern E1 onto the first sewing object C1, and sew the second pattern E2 onto the second sewing object C2, while the second frame 83 is open with respect to the first frame 82. Then, the embroidery frame 80 enables the first sewing object C1 and the second sewing object C2 to be overlapped while the position of the first sewing object C1 with respect to the first frame 82, and the position of the second sewing object C2 with respect to the second frame 83, are maintained as a result of the second frame 83 being closed with respect to the first frame 82. With the sewing machine 1 on which the embroidery frame 80 is mounted, the embroidery frame 80 can be closed such that stitching of the outline N can be formed in accordance with the arrangement of both of the patterns E1 and E2. The embroidery frame 80 enables the position of the second sewing object C2 with respect to the first sewing object C1 to be aligned by a simpler operation than in the past, even when a pattern is sewn on both the first sewing object C1 and the second sewing object C2.

The embroidery frame 80 includes the restricting portion 78 that restricts the second frame 83 from rotating more than a predetermined angle with respect to the first frame 82. The second frame 83 includes the abutting portion 91 that abuts against the restricting portion 78 when the second frame 83 is opened a predetermined angle with respect to the first frame 82. Therefore, the embroidery frame 80 can reliably restrict the second frame 83 from rotating beyond a predetermined angle with respect to the first frame 82.

The rotational center M of the hinge portions 84 extends in a direction intersecting the longitudinal direction of the mounting portion 81. Therefore, with the embroidery frame 80, it is easier to balance the entire embroidery frame 80 while the second frame 83 is open with respect to the first frame 82 than it is with an embroidery frame in which the second frame 83 is on the side opposite the mounting portion 81 side with respect to the first frame 82, while the second frame 83 is open with respect to the first frame 82. The sewing machine 1 on which the embroidery frame 80 is mounted can sew a pattern more stably than it can in a case where the second frame 83 is on the side opposite the mounting portion 81 side with respect to the first frame 82.

The mounting portion 81 of the embroidery frame 80 is provided on an extension line of the rotational center M of the hinge portions 84. Therefore, with the embroidery frame 80, the balance when mounting the embroidery frame 80 to the holder 43 while the second frame 83 is open with respect to the first frame 82 is better than it is with an embroidery frame in which the mounting portion 81 is not on the extension line of the rotational center M of the hinge portions 84. The sewing machine 1 on which the embroidery frame 80 is mounted can sew a pattern more stably than the sewing machine 1 on which the embroidery frame including the mounting portion 81 that is not on the extension line of the rotational center M of the hinge portions 84 is mounted.

The mounting portion 81 of the embroidery frame 80 has the connecting portion 92 that connects to the first frame 82 at one end side in the longitudinal direction, and has the restricting portion 78 on the other end side in the longitudinal direction. Therefore, with the embroidery frame 80, it is easier to balance the entire embroidery frame 80 while the second frame 83 is open with respect to the first frame 82.

The abutting portion 91 of the embroidery frame 80 is provided on the opposite side of the second frame 83 from the side that is connected to the hinge portions 84, and on the side of the second frame 83 that faces the restricting portion 78. The restricting portion 78 is a portion that protrudes in a direction toward the second frame 83 from the mounting portion 81 while the second frame 83 is open with respect to the first frame 82. Therefore, the embroidery frame 80 can effectively restrict the second frame 83 from rotating beyond a predetermined angle at the abutting portion 91, by a relatively simple configuration.

The embroidery frame 80 includes the fixing portion 90 that fixes the position of the second frame 83 with respect to the first frame 82, in a state in which the abutting portion 91 is abutted against the restricting portion 78. The embroidery frame 80 can be reliably kept a state in which the second frame 83 is open with respect to the first frame 82. The embroidery frame 80 can inhibit the second frame 83 from jouncing in the up-down direction due to vibration or the like during sewing. The sewing machine 1 on which the embroidery frame 80 is mounted can stably sew a pattern onto each of the first sewing object C1 clamped by the first frame 82 and the first clamping portion 85, and the second sewing object C2 clamped by the second frame 83 and the second clamping portion 86, while the second frame 83 is open with respect to the first frame 82.

The first frame 82 includes the first magnetic body 2, and the second frame 83 includes the second magnetic body 3. The first clamping portion 85 is in the shape of a frame capable of clamping the first sewing object C1 with the first frame 82 by magnetic force, and includes the first magnets 93 in a position facing the first magnetic body 2 in the clamping position. The second clamping portion 86 is in the shape of a frame capable of clamping the second sewing object C2 with the second frame 83 by magnetic force, and includes the second magnets 95 in a position facing the second magnetic body 3 in the clamping position. Therefore, the embroidery frame 80 can clamp the first sewing object C1 between the first frame 82 and the first clamping portion 85 with magnetic force, and can clamp the second sewing object C2 between the second frame 83 and the second clamping portion 86 with magnetic force. With the embroidery frame 80, the first clamping portion 85 and the second clamping portion 86 are separate, so the operation of clamping the first sewing object C1 with the first frame 82 and the first clamping portion 85, and the operation of clamping the second sewing object C2 with the second frame 83 and the second clamping portion 86, are easy. With the embroidery frame 80, the first clamping portion 85 and the second clamping portion 86 are in the shape of frames, so it is easy to clamp the first sewing object C1 and the second sewing object C2 with even tension.

When the first clamping portion 85 and the second clamping portion 86 are provided in the clamping position and the second frame 83 is closed with respect to the first frame 82, as shown in FIG. 4(B), the second clamping portion 86 is not in a position facing the first magnets 93, and the first clamping portion 85 is not in a position facing the second magnets 95. Therefore, with the embroidery frame 80, the overall thickness of the embroidery frame 80 while the second frame 83 is closed with respect to the first frame 82 can be thinner than it can be with an embroidery frame in which there is a clamping portion in a position facing a magnet.

The embroidery frame 80 has the lock mechanism 89 configured to fix the second frame 83 with respect to the first frame 82 while the second frame 83 is closed with respect to the first frame 82. The embroidery frame 80 can be reliably kept a state in which the second frame 83 is closed with respect to the first frame 82. The sewing machine 1 on which the embroidery frame 80 is mounted can stably sew the first sewing object C1 and the second sewing object C2 that are clamped by the embroidery frame 80, while the second frame 83 is closed with respect to the first frame 82.

The embroidery frame 80 further includes the detection portion 97 configured to detect the state where the second frame 83 is closed with respect to the first frame 82. The sewing machine 1 on which the embroidery frame 80 is mounted can ascertain, by the detection portion 97, whether the second frame 83 is closed with respect to the first frame 82. The sewing machine 1 can determine whether to execute sewing, in accordance with the open/closed state of the embroidery frame 80, by detecting the state of the detection portion 97 with the detector 36. Therefore, the sewing machine 1 can reliably avoid stitches being formed when the embroidery frame 80 is in an incorrect state.

An embroidery frame of the present disclosure is not limited to the above described embodiment, and various changes may be made without departing from the spirit and scope of the present disclosure. For example, the following modifications may be added as appropriate.

The configuration of the sewing machine 1 on which the embroidery frame 80 can be mounted may be modified as appropriate. The sewing machine 1 may be an industrial sewing machine or a multi-needle sewing machine. It is sufficient that the movement mechanism 40 be such that the holder 43 is able to move relative to the needle bar 6 in a first direction and a direction intersecting the first direction. The movement mechanism 40 may be integrally formed with the sewing machine 1. At least one of components selected from the group of the restricting portion, the abutting portion, the fixing portion, the detecting portion, the lock mechanism, the first magnet, and the second magnet may be omitted as appropriate. or the configuration of the at least one of the components, such as the shape and arrangement, may be changed as appropriate. The first frame 82 and the second frame 83 need not be formed by magnetic bodies. The first frame 82 and the second frame 83 may be formed by magnetic bodies only at the portions facing the first clamping portion 85 and the second clamping portion 86, respectively. The first frame 82 and the second frame 83 may be symmetrical or asymmetrical with respect to the rotational center of the hinge portions 84. If the first frame 82 and the first clamping portion 85 do not hold the first sewing object by magnetic force, the first clamping portion 85, for example, may be a clip or the like. Similarly, the second clamping portion 86 may be a clip or the like. The first clamping portion 85 and the second clamping portion 86 may be a single member or separate members. At least one selected from the group of the first clamping portion 85 and the second clamping portion 86 does not have to be shaped like a frame. The number, arrangement, and shape and the like of the first magnet 93 with respect to the first clamping portion 85 may be changed as appropriate. Similarly, the number, arrangement, and shape and the like of the second magnet 95 with respect to the second clamping portion 86 may be changed as appropriate. Magnets may be disposed on portions of the clamping portions 85 and 86 that are on the hinge portions 84 side. At least one selected from the group of the first clamping portion 85 and the second clamping portion 86 may be a magnet sheet. A clamping portion may be in a position facing a magnet when the second frame 83 is closed with respect to the first frame 82.

The shape and size of the embroidery frame 80 may be changed as appropriate. The embroidery frame 80 may have a circular or oval shape or the like. The arrangement of the first frame, the second frame, and the mounting portion may be changed as appropriate. The rotational center M of the hinge portions 84 may extend in a direction intersecting the longitudinal direction of the mounting portion 81, or may extend parallel to the longitudinal direction of the mounting portion 81. The mounting portion 81 need not be provided on the extension line of the rotational center M of the hinge portions 84. When the rotational center M of the hinge portions 84 extends parallel to the longitudinal direction of the mounting portion 81, the mounting portion may have a connecting portion that connects to the first frame along the longitudinal direction of the mounting portion, and an arm portion which connects to one end portion in the longitudinal direction of the mounting portion and extends in a direction intersecting the longitudinal direction of the mounting portion. A restricting portion may be provided on the arm portion. In this case, the abutting portion may be provided on the opposite side of the second frame from the side that is connected to the hinge portions, and on the side of the second frame that faces the restricting portion, and the lock mechanism and the detecting portion may be provided on the mounting portion. Also, in a case where the rotational center M of the hinge portions 84 extends parallel to the longitudinal direction of the mounting portion 81, The at least one of the components including the restricting portion, the abutting portion, the fixing portion, the detecting portion, the lock mechanism, the first magnet, and the second magnet may each be omitted as appropriate.

The detecting portion need simply be able to detect when the second frame 83 is closed with respect to the first frame 82, and may be a known mechanical switch or the like. The first frame may be connected to the connecting portion by a method other than screws, such as welding, or the first frame may be integrally formed with the mounting portion. It is sufficient that the hinge portions 84 be able to connect the first frame 82 and the second frame 83 such that the second frame 83 can rotate relative to the first frame 82. The number and arrangement of the hinge portions 84 may be changed as appropriate. Aside from being used in the sewing processing shown in FIG. 8, the embroidery frame 80 may be used, as appropriate, in other processing such as normal pattern sewing, free motion sewing, and bobbin work sewing.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An embroidery frame comprising:

a mounting portion to be mounted on a sewing machine capable of embroidery sewing; and a frame portion configured to hold a first sewing object and a second sewing object, the frame portion having a first frame, a hinge portion, a second frame, a first clamping portion, and a second clamping portion, the first frame being connected to the mounting portion and configured to hold the first sewing object, the hinge portion being connected to one end of the first frame, the second frame being connected at one end to the hinge portion such that the second frame is able to rotate with respect to the first frame, the second frame having an enclosed frame shape, the second frame being configured to hold the second sewing object, the first clamping portion being configured to clamp the first sewing object together with the first frame while the second frame is open with respect to the first frame, and the second clamping portion being configured to clamp the second sewing object together with the second frame while the second frame is open with respect to the first frame, at least one of the first clamping portion or the second clamping portion having a perimeter that is an enclosed frame shape.

2. The embroidery frame according to claim 1, further comprising:

a restricting portion configured to restrict the second frame from rotating beyond a predetermined angle with respect to the first frame, wherein the second frame is provided with an abutting portion that abuts against the restricting portion when the second frame is opened the predetermined angle with respect to the first frame.

3. The embroidery frame according to claim 2, wherein the mounting portion has a connecting portion that connects to the first frame on one end side in the longitudinal direction, and has the restricting portion on the other end side in the longitudinal direction.

4. The embroidery frame according to claim 3, wherein the abutting portion is provided on the opposite side of the second frame from the side connected to the hinge portion, and on the side of the second frame facing the restricting portion, and the restricting portion is a portion protruding in a direction toward the second frame from the mounting portion while the second frame is open with respect to the first frame.

5. The embroidery frame according to claim 1, wherein a rotational center of the hinge portion extends in a direction intersecting the longitudinal direction of the mounting portion.

6. The embroidery frame according to claim 5, wherein the mounting portion is provided on an extension line of the rotational center of the hinge portion.

7. The embroidery frame according to claim 1, further comprising:

a lock mechanism configured to fix the second frame to the first frame while the second frame is closed with respect to the first frame.

8. The embroidery frame according to claim 1, further comprising:

a detection portion configured to detect a state where the second frame is closed with respect to the first frame.

9. An embroidery frame comprising:

a mounting portion to be mounted on a sewing machine capable of embroidery sewing; and a frame portion configured to hold a first sewing object and a second sewing object, the frame portion having a first frame, a hinge portion, a second frame, a first clamping portion, and a second clamping portion, the first frame being connected to the mounting portion and configured to hold the first sewing object, the hinge portion being connected to one end of the first frame, the second frame being connected at one end to the hinge portion such that the second frame is able to rotate with respect to the first frame, the second frame having a frame shape, the second frame being configured to hold the second sewing object, the first clamping portion being configured to clamp the first sewing object together with the first frame while the second frame is open with respect to the first frame, and the second clamping portion being configured to clamp the second sewing object together with the second frame while the second frame is open with respect to the first frame;

a restricting portion configured to restrict the second frame from rotating beyond a predetermined angle with respect to the first frame, wherein the second frame is provided with an abutting portion that abuts against the restricting portion when the second frame is opened the predetermined angle with respect to the first frame, and the embroidery frame further comprises a fixing portion configured to fix the position of the second frame with respect to the first frame, in a state in which the abutting portion is abutted against the restricting portion.

10. An embroidery frame comprising:

a mounting portion to be mounted on a sewing machine capable of embroidery sewing; and a frame portion configured to hold a first sewing object and a second sewing object, the frame portion having a first frame, a hinge portion, a second frame, a first clamping portion, and a second clamping portion, the first frame being connected to the mounting portion and configured to hold the first sewing object, the hinge portion being connected to one end of the first frame, the second frame being connected at one end to the hinge portion such that the second frame is able to rotate with respect to the first frame, the second frame having a frame shape, the second frame being configured to hold the second sewing object, the first clamping portion being configured to clamp the first sewing object together with the first frame while the second frame is open with respect to the first frame, and the second clamping portion being configured to clamp the second sewing object together with the second frame while the second frame is open with respect to the first frame, wherein the first frame includes a first magnetic body, the second frame includes a second magnetic body, the first clamping portion is in the shape of a frame configured to clamp the first sewing object with the first frame by magnetic force, and includes a first magnet in a position facing the first magnetic body in a clamping position, and the second clamping portion is in the shape of a frame configured to clamp the second sewing object with the second frame by magnetic force, and includes a second magnet in a position facing the second magnetic body in the clamping position.

11. The embroidery frame according to claim 10, wherein when the first clamping portion and the second clamping portion are each provided in the clamping position, and the second frame is closed with respect to the first frame, the second clamping portion is not in a position facing the first magnet, and the first clamping portion is not in a position facing the second magnet.

* * * * *